US005636395A

United States Patent [19]

Serda

[11] Patent Number: 5,636,395

[45] Date of Patent: Jun. 10, 1997

[54] MATTRESS PAD WITH GEL FILLED CHAMBERS COUPLED TO A FOAM CUSHION

[76] Inventor: Jarrett F. M. Serda, 6000 Arvilla Ave. NE., Albuquerque, N.Mex. 87110

[21] Appl. No.: 384,028

[22] Filed: Feb. 6, 1995

[51] Int. Cl.[6] ..... A47C 27/10

[52] U.S. Cl. ..... 5/691; 5/676; 5/655.5; 5/909; 5/740

[58] Field of Search ..... 5/455, 449, 654, 5/909, 691, 710, 707, 655.5, 676, 740

[56] References Cited

U.S. PATENT DOCUMENTS

| | | | |
|---|---|---|---|
| 2,575,764 | 11/1951 | Morner | 5/457 |
| 3,468,311 | 9/1969 | Gallagher | 5/455 |
| 4,454,615 | 6/1984 | Whitney | 5/449 |
| 4,471,538 | 9/1984 | Pomeranz | 5/909 |
| 4,472,472 | 9/1984 | Schultz | 5/420 |
| 4,698,109 | 10/1987 | Lazar | 5/455 |
| 4,788,730 | 12/1988 | Bexton | 5/909 |
| 5,167,999 | 12/1992 | Wang | 5/644 |
| 5,369,828 | 12/1994 | Graebe | 5/654 |

*Primary Examiner*—Alexander Grosz

[57] ABSTRACT

A pad for individually supporting portions of a human body relative to a mattress. The inventive device includes a flexible pad positionable atop a mattress of a bed. An individual support assembly is coupled to an upper surface of the flexible pad and includes a plurality of separate chambers individually filled with a viscous gel to individually support each contacting portion of a human body relative to the mattress. In a preferred embodiment the flexible pad is a foam cushion that is substantially thicker than the height of the gel filled chambers.

2 Claims, 4 Drawing Sheets

MATTRESS PAD WITH GEL FILLED CHAMBERS COUPLED TO A FOAM CUSHION

BACKGROUND OF THE INVENTION

1. Field of the Invention

The present invention relates to bedding devices and more particularly pertains to a compartmented mattress pad for individually supporting portions of a human body relative to a mattress.

2. Description of the Prior Art

The use of bedding devices is known in the prior art. More specifically, bedding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art bedding devices include U.S. Pat. No. 5,167,999; U.S. Pat. No. 4,858,259; U.S. Pat. No. 4,788,730; U.S. Pat. No. 4,445,240; and U.S. Pat. No. 3,689,948.

While these devices fulfill their respective, particular objectives and requirements, the aforementioned patents do not disclose a compartmented mattress pad for individually supporting portions of a human body relative to a mattress which includes a flexible pad positionable atop a mattress of a bed, and an individual support assembly coupled to an upper surface of the flexible pad which includes a plurality of separate chambers individually filled with a viscous gel to individually support each contacting portion of a human body relative to the mattress.

In these respects, the compartmented mattress pad according to the present invention substantially departs from the conventional concepts and designs of the prior art, and in so doing provides an apparatus primarily developed for the purpose of individually supporting portions of a human body relative to a mattress.

SUMMARY OF THE INVENTION

In view of the foregoing disadvantages inherent in the known types of bedding devices now present in the prior art, the present invention provides a new compartmented mattress pad construction wherein the same can be utilized for supporting a human body relative to a mattress. As such, the general purpose of the present invention, which will be described subsequently in greater detail, is to provide a new compartmented mattress pad apparatus and method which has many of the advantages of the bedding devices mentioned heretofore and many novel features that result in a compartmented mattress pad which is not anticipated, rendered obvious, suggested, or even implied by any of the prior art bedding devices, either alone or in any combination thereof.

To attain this, the present invention generally comprises a pad for individually supporting portions of a human body relative to a mattress. The inventive device includes a flexible pad positionable atop a mattress of a bed. An individual support assembly is coupled to an upper surface of the flexible pad and includes a plurality of separate chambers individually filled with a viscous gel to individually support each contacting portion of a human body relative to the mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new compartmented mattress pad apparatus and method which has many of the advantages of the bedding devices mentioned heretofore and many novel features that result in a compartmented mattress pad which is not anticipated, rendered obvious, suggested, or even implied by any of the prior art bedding devices, either alone or in any combination thereof.

It is another object of the present invention to provide a new compartmented mattress pad which may be easily and efficiently manufactured and marketed.

It is a further object of the present invention to provide a new compartmented mattress pad which is of a durable and reliable construction.

An even further object of the present invention is to provide a new compartmented mattress pad which is susceptible of a low cost of manufacture with regard to both materials and labor, and which accordingly is then susceptible of low prices of sale to the consuming public, thereby making such compartmented mattress pads economically available to the buying public.

Still yet another object of the present invention is to provide a new compartmented mattress pad which provides in the apparatuses and methods of the prior art some of the advantages thereof, while simultaneously overcoming some of the disadvantages normally associated therewith.

Still another object of the present invention is to provide a new compartmented mattress pad for individually supporting portions of a human body relative to a mattress.

Yet another object of the present invention is to provide a new compartmented mattress pad which includes a flexible pad positionable atop a mattress of a bed, and an individual support assembly coupled to an upper surface of the flexible pad which includes a plurality of separate chambers individually filled with a viscous gel to individually support each contacting portion of a human body relative to the mattress.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
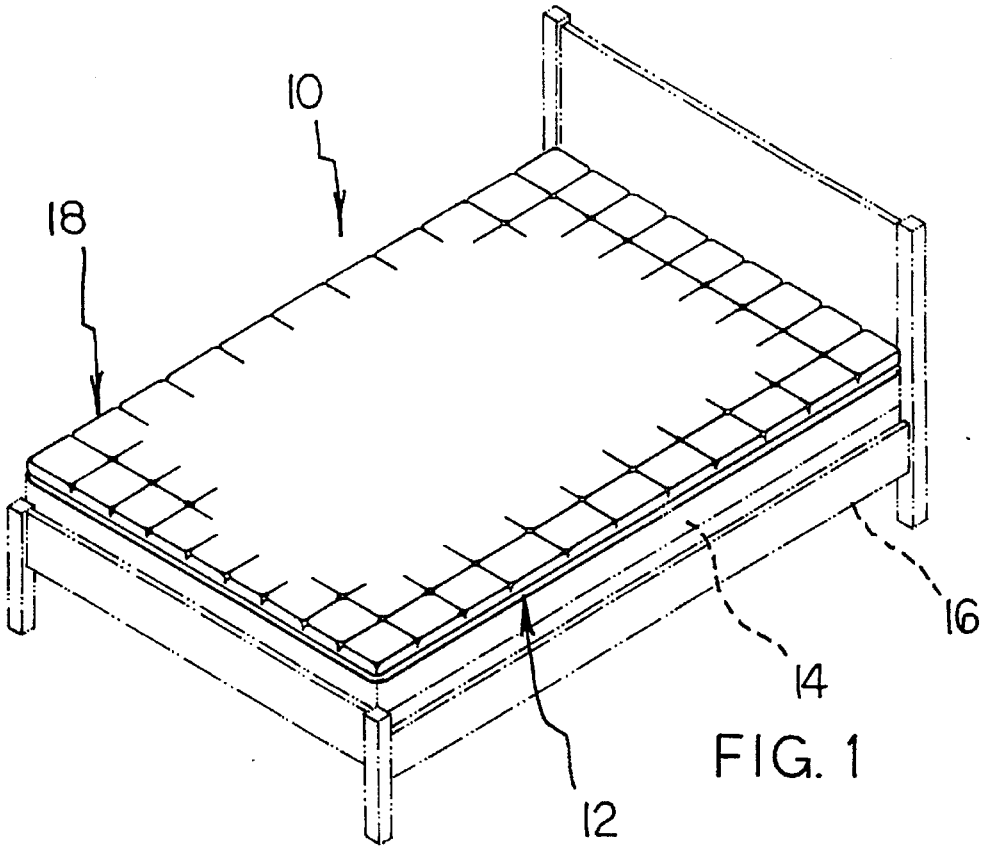
FIG. 1 is an isometric illustration of a compartmented mattress pad according to the present invention in use.

With reference now to the drawings, and in particular to FIGS. 1–8 thereof, a new compartmented mattress pad embodying the principles and concepts of the present invention and generally designated by the reference numeral 10 will be described.

More specifically, it will be noted that the compartmented mattress pad 10 comprises a flexible pad means 12 for coextensively positioning atop a mattress 14 of a bed 16, as illustrated in FIG. 1 for example. An individual support means 18 is coupled to an upper surface of the flexible pad means 12 so as to coextensively cover the flexible pad means and operates for individually supporting portions of a human body relative to the mattress 14.

Figure 4:
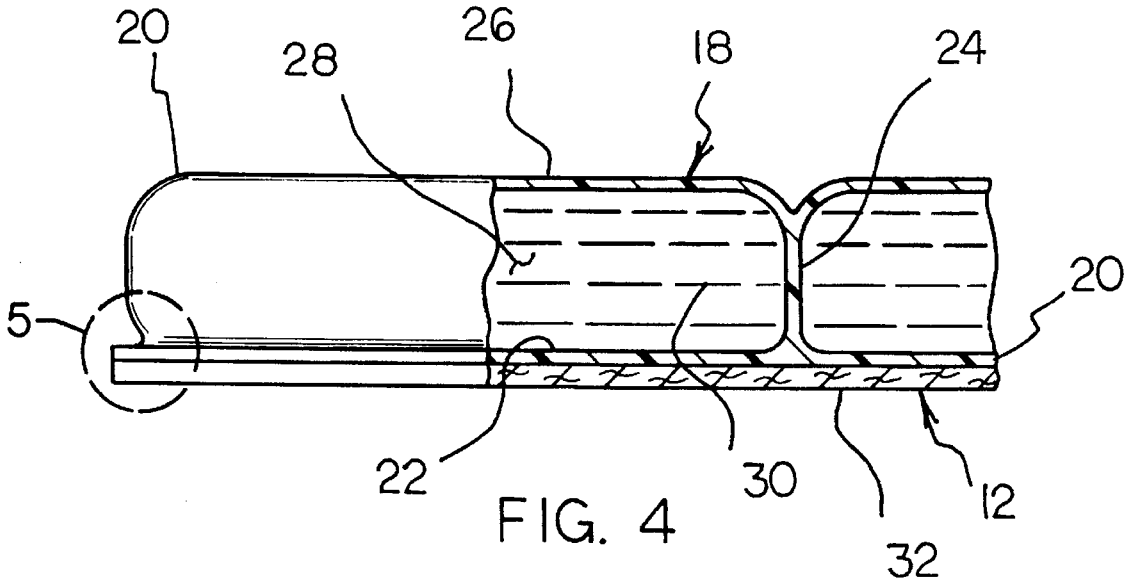
FIG. 4 is an enlarged side elevation view, partially in cross section, of a portion of the present invention.
Figure 5:
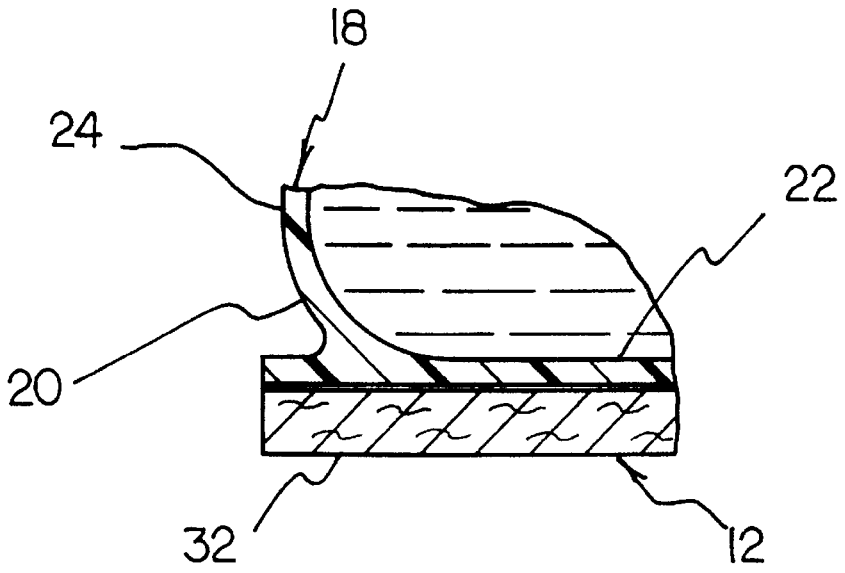
FIG. 5 is an enlarged cross sectional view of the area set forth in FIG. 4.

As shown in FIGS. 2 through 5 of the drawings, the individual support means 18 according to the present invention 10 preferably comprises a plurality of separate chambers 20 which are secured to the flexible pad means 12 so as to be positioned in adjacency relative to one another. The separate chambers 20, as shown in FIGS. 4 and 5 of the drawings, each include a flexible lower panel 22 secured to the upper surface of the flexible pad means 12 by a suitable adhesive or other conventionally known means. A plurality of flexible vertical panels 24 project upwardly from the flexible lower panel 22 in a spaced relationship relative to one another. A flexible upper panel 26 extends between the flexible lateral panels 24 of an individual one of the separate chambers 20 to define an interior compartment 28 within an individual one of the chambers. A viscous gel 30 is positioned within the interior compartment 28 to support the flexible upper panel 26 relative to the flexible lower panel 22 and to the flexible pad means 12 to which the lower panel is attached. By this structure, each of the separate chambers 20 operates to support an individual portion of a human body relative to the flexible means 12 and the mattress 14 when the device 10 is positioned relative to a bed 16 as shown in FIG. 1. It is important to note that the interior compartments 28 of each of the separate chambers 20 are precluded from fluid communication with the interior compartments of adjacent chambers 20. Such isolation of the viscous gel 30 within each of the interior compartments 28 of the separate chambers 20 precludes a pressure induced biasing of the viscous gel 30 into outer portions of the individual support means 18. Thus, each of the separate chambers 20 operates independently relative to adjacent separate chambers to support an individual portion of a human body.

As best illustrated in FIGS. 4 and 5, it can be shown that the flexible pad means 12 according to the present invention 10 preferably comprises a fabric web 32 coupled to and extending coextensively relative to the flexible lower panel 22 of the individual support means 18. The fabric web 32, as noted above for the flexible pad means 12, can be adhesively or otherwise secured to a lower surface of the flexible lower panel 22.

Figure 6:
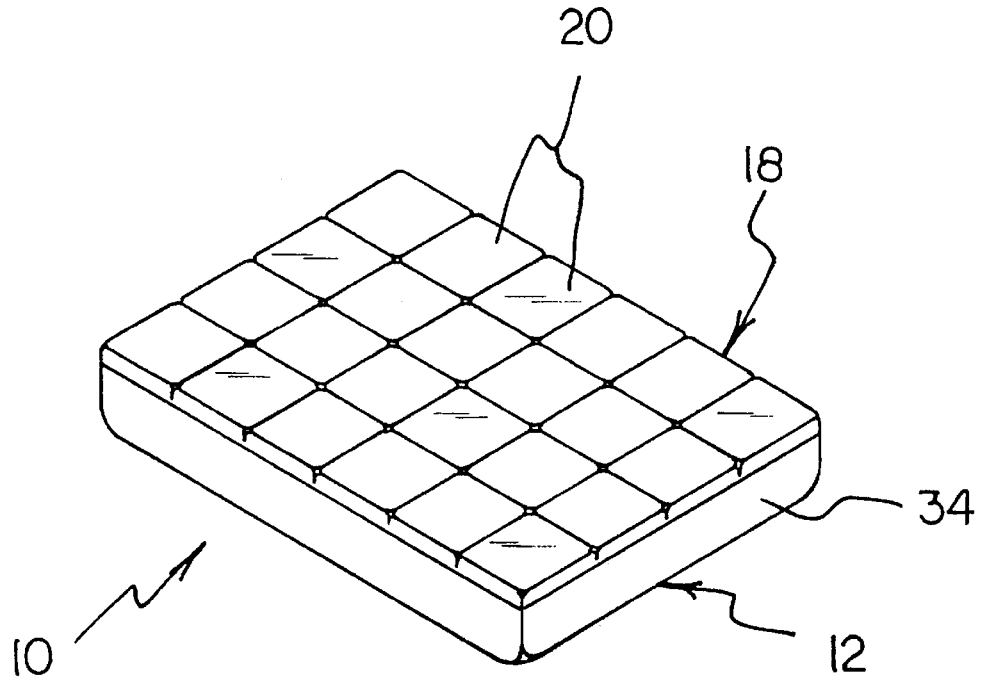
FIG. 6 is an isometric illustration of the invention including an alternative form of a flexible pad means.
Figure 7:
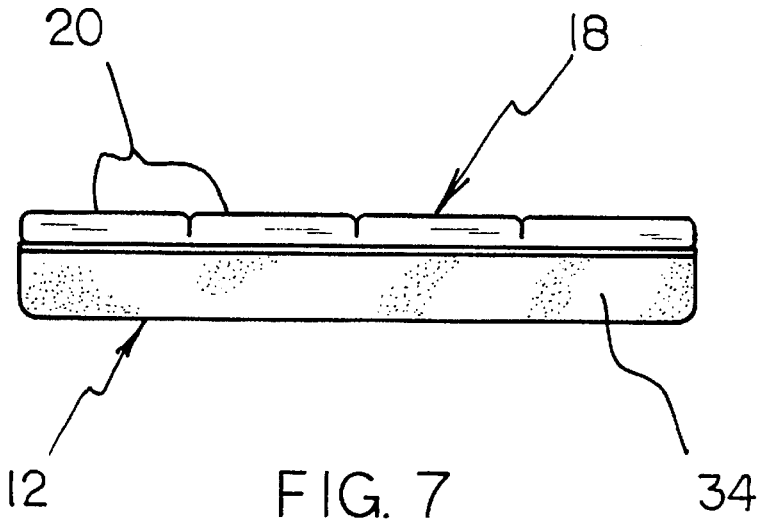
FIG. 7 is a front elevation view of the invention including the alternative form of the flexible pad means.
Figure 8:
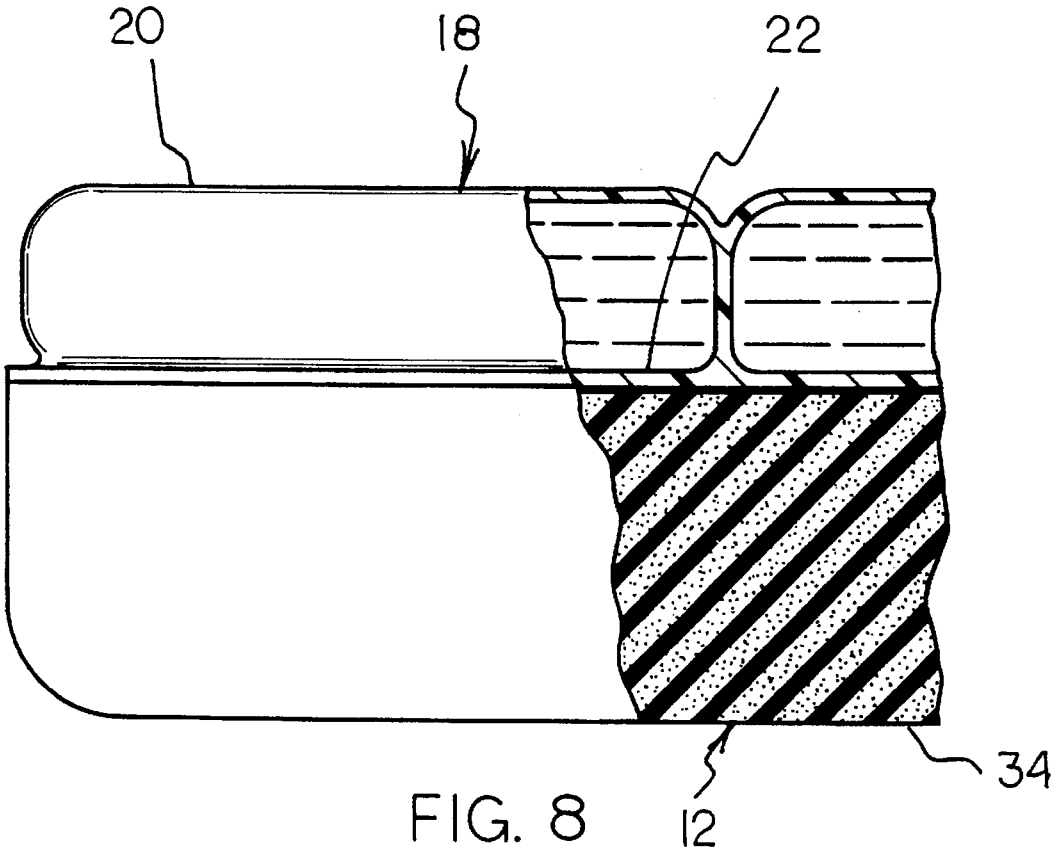
FIG. 8 is an enlarged side elevation view, partially in cross section, of the invention as illustrated in FIGS. 6 and 7.

Referring now to FIGS. 6 through 8, it can be shown that the flexible pad means 12 according to the present invention 10 may alternatively comprise a foam cushion 34 coupled to a lower surface of the flexible lower panel 22 by an adhesive or other suitable securing means. As shown in FIG. 8, the foam cushion 34 is of a first height dimension, with the individual support means 18 being of a second height dimension, wherein the first height dimension of the foam cushion 34 is substantially greater than the second height dimension of the individual support means. By this structure, the alternative form of the flexible pad means 12 illustrated in FIGS. 6 through 8 permits the device 10 to be utilized as a pillow. In contrast and as shown in FIGS. 4 and 5, the fabric web 32 of the flexible pad means 12 is of a third height dimension, wherein the second height dimension of the individual support means 18 is substantially greater than the third height dimension of the fabric web 32 to permit the device as illustrated in FIGS. 1 through 5 to be utilized as a mattress pad.

Figure 2:
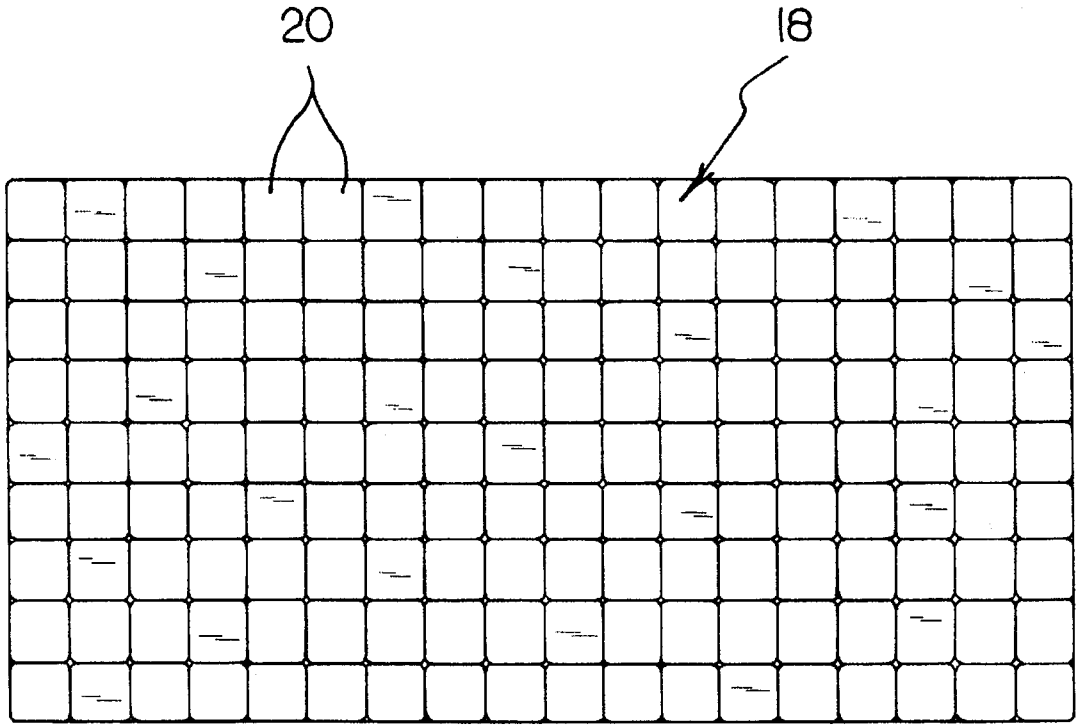
FIG. 2 is a top plan view of the invention, per se.
Figure 3:
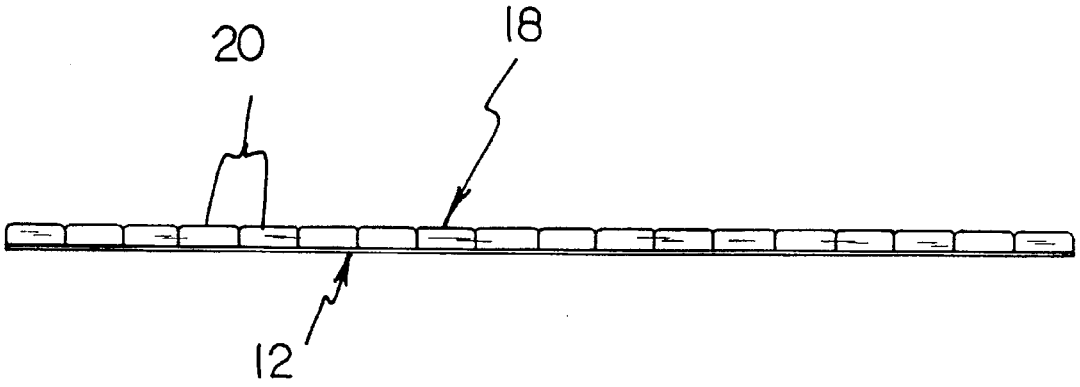
FIG. 3 is a side elevation view thereof.

As shown in FIG. 2, the separate chambers 20 are preferably shaped so as to be substantially square in shape. In other words, a longitudinal dimension of each of the separate chambers 20 is substantially equal to a transverse dimension thereof to define the substantially square shape as illustrated in the plan view of FIG. 2. Further, it is desirable that the individual support means 18 comprise a minimum of at least six separate chambers 20 so as to provide the individual support of separate portions of the human body while still permitting the flexible pad means 12 to assume a substantially rectangular shape defined by a longitudinal dimension of the flexible pad means 12 being substantially greater than a transverse dimension thereof.

In use, the compartmented mattress pad 10 according to the present invention can be easily positioned on top of a mattress 14 of a bed 16 to individually support portions of a human body relative to the mattress. The separate chambers 20 of the individual support means 18 each provide an equal amount of support to individual portions of the body and remain substantially unaffected by pressures applied to adjacent separate chambers 20 of the individual support means.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A compartmented mattress pad comprising:

a flexible pad means for coextensively positioning atop a mattress of a bed;

an individual support means coupled to an upper surface of the flexible pad means so as to coextensively cover the flexible pad means and for individually supporting portions of a human body relative to the mattress;

the individual support means comprising a plurality of separate chambers secured to the flexible pad means so as to be positioned in adjacency relative to one another; and the separate chambers each including a flexible lower panel secured to a upper surface of the flexible pad means, a plurality of flexible vertical panels projecting upwardly from the flexible lower panel in a spaced relationship relative to one another, a flexible upper panel extending between the flexible vertical panels of an individual one of the separate chambers to define an interior compartment, and a viscous gel positioned within the interior compartment to support the flexible upper panel relative to the flexible lower panel; the interior compartments of each of the separate chambers being sealed to preclude fluid communication with interior compartments of adjacent chambers so as to preclude a pressure induced biasing of the viscous gel into outer portions of the individual support means;

the flexible pad means comprising a foam cushion coupled to a lower surface of the flexible lower panel, the foam cushion being of a first height dimension, with the individual support means being of a second height dimension, wherein the first height dimension of the foam cushion is substantially greater than the second height dimension of the individual support means.

2. The compartmented mattress pad of claim 1, wherein the separate chambers are shaped so as to be substantially square in shape such that a longitudinal dimension of each of the separate chambers is substantially equal to a transverse dimension of each of the separate chambers to define the substantially square shape thereof.

* * * * *